US011122920B2

(12) United States Patent
Tyler et al.

(10) Patent No.: US 11,122,920 B2
(45) Date of Patent: Sep. 21, 2021

(54) PERSONAL EGG PEELER

(71) Applicants: Margaret B. Tyler, Fairfield, CT (US); Sheila M. Torgan, Wilton, CT (US)

(72) Inventors: Margaret B. Tyler, Fairfield, CT (US); Sheila M. Torgan, Wilton, CT (US)

( * ) Notice: Subject to any disclaimer, the term of this patent is extended or adjusted under 35 U.S.C. 154(b) by 214 days.

(21) Appl. No.: 15/978,279

(22) Filed: May 14, 2018

(65) Prior Publication Data

US 2019/0343311 A1 Nov. 14, 2019

Related U.S. Application Data

(63) Continuation-in-part of application No. 15/917,102, filed on Mar. 9, 2018, now Pat. No. 10,779,685.

(51) Int. Cl.
*A47G 19/28* (2006.01)

(52) U.S. Cl.
CPC ..... *A47G 19/28* (2013.01)

(58) Field of Classification Search
CPC ..... A47G 19/28; A47J 43/14; A47J 17/02; A23N 7/00; A23N 15/08
See application file for complete search history.

(56) References Cited

U.S. PATENT DOCUMENTS 2,962,067 A * 11/1960 Mesojedec ..... A47G 19/28 99/516
4,149,456 A * 4/1979 Gisonni ..... A47G 19/28 30/120.1

* cited by examiner

*Primary Examiner* — Christopher J Besler
*Assistant Examiner* — Christine Bersabal
(74) *Attorney, Agent, or Firm* — John L. Sotomayor

(57) ABSTRACT

An apparatus is described that permits a user to quickly and effortlessly separate an egg shell from the body of a hard-boiled egg. The apparatus has a hollow body into which an egg is inserted, a convex shaped bottom section and a convex shaped top portion. Additionally, the interior surface of the hollow body has a number of protrusions that contribute to peeling action. Eggs are inserted into the apparatus, water is added, the apparatus is sealed, the user agitates the apparatus for a short time, and then pours out the separated egg and egg shell along with the water.

8 Claims, 6 Drawing Sheets

PERSONAL EGG PEELER

PRIORITY CLAIM

This Non-Provisional application claims under 35 U.S.C. § 120, the benefit of priority to the Provisional Application 62/163,062, filed May 15, 2015, and Titled "Personal Egg Peeler", and claims the benefit of priority as a Continuation In Part of patent application Ser. No. 15/156,785, filed May 17, 2016 and Titled "Personal Egg Peeler", each of which are hereby incorporated by reference in their entirety.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

The present invention relates generally to food preparation, and specifically to preparing hard boiled eggs for consumption. Removing the shell of a hard-boiled egg is a tedious process, especially if there is little time prior to the consumption of the eggs. Commercial processes for removing the shell do not apply to home makers and other consumers of small numbers of eggs over a set period of time as the machines used are generally large, cumbersome, and expensive, although effective.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
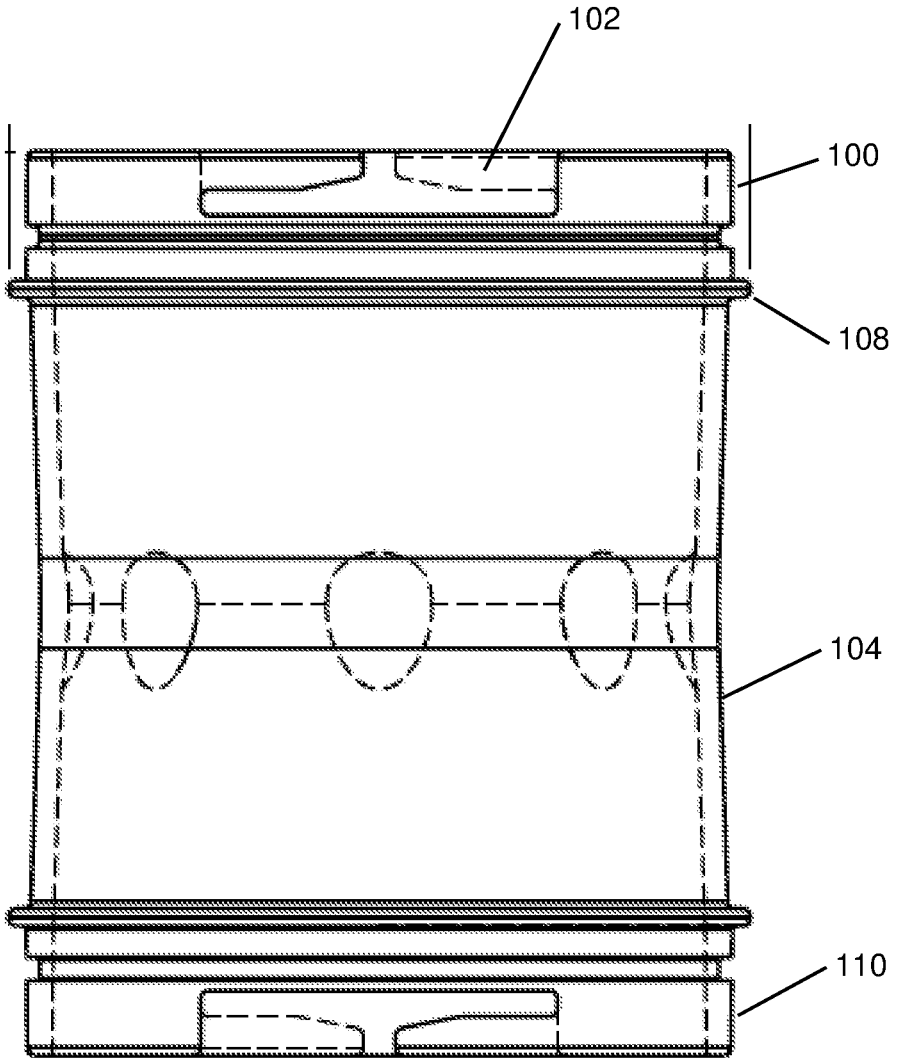
FIG. 1 is a view of the exterior of a personal egg peeler apparatus consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

A apparatus used for peeling commercial quantities of hard-boiled eggs, for use in such food items as egg-salad as an example, are often large, cumbersome, and expensive. The number of eggs to be peeled must, therefore, be quite large in order to justify the expense for such an apparatus.

Peeling more than a dozen, but less than a quantity that would justify the investment in a commercial size egg peeling apparatus, is a tedious, time-consuming task. However, peeling one, two, or a dozen hard-boiled eggs remains a tedious task, even though this process may not consume a large amount of time. There is a need for a personal egg peeler that removes the shell of a hard-boiled egg speedily and with little effort, while still remaining cost effective to purchase for a personal kitchen, or a low-volume commercial kitchen.

The egg peeler apparatus herein disclosed provides a low-cost, readily portable solution for the peeling of small quantities of hard-boiled eggs. The apparatus is configured to peel the eggs, separate the shell from the egg white, and perform this process in a very short time cycle. The apparatus consists of a cylindrical main body having convex end caps that are configured to be attached and removed from the cylindrical main body, and oval shaped protrusions extending from the interior surface of the cylindrical main body. The cylindrical main body is of sufficient diameter to permit the insertion of one or more eggs produced by a commercial variety hen. However, this should in no way be considered limiting as the cylindrical main body may be sized to accommodate eggs lain by other species of fowl as well.

The egg peeler has a top portion, also with a convex surface that faces the interior of the cylindrical main body, having a water tight connection and seal for sealing the apparatus when the top portion is connected to the main body. The convex end caps form the top and bottom portions of the apparatus when connected to the main body. Each end cap may have a water tight connection such as a gasket, an o-ring, a screw type fastener, or any other type of fastener that keeps water sealed inside the main body when the end caps are secured to the top and bottom portions of the main body. In operation, a user may remove the top portion of the egg peeler with the egg peeler oriented in a vertical plane, place one or more eggs of sufficient diameter to be fully enclosed by the main body of the egg peeler when inserted into the egg peeler, pour water sufficient to cover a third of the volume of the eggs when inserted into the main body, and replace the top convex end cap onto the top of the cylinder with sufficient force to cause the convex top portion to seal the main body of the cylinder so as to retain both the egg and the water within the main body of the egg peeler. The user then shakes the egg peeler apparatus for a predetermined time and removes one of the convex end cap portions, unsealing the egg peeler main body to permit removal of the separated egg and egg shell portions from the cylindrical main body of the apparatus.

Although particular exemplary embodiments of the innovation will be presented herein, it should be apparent that additional embodiments may be accessible to those of ordinary skill in the art without departing from the spirit of innovation of the recited embodiments.

Turning now to FIG. 1, consistent with certain embodiments of the invention this figure is a view of the personal egg peeler apparatus consistent with certain embodiments of the present invention. In this exemplary embodiment, a top portion 100 of a personal egg peeler apparatus is presented as having a substantially circular cross section. However, this should in no way be considered limiting as the top portion 100 may be manufactured in any shape that is consistent with the shape of the main body of the personal egg peeler and may be oval, square, rectangular or any other shape that permits the top portion 100 to be inserted into or onto the top of the main body 104 of the personal egg peeler. The top portion 100 may also have a convex shaped portion 102 so as to permit a user to insert a thumb or fingers into the convex shaped portion 102 to readily grasp the top portion 100 of the personal egg peeler when in use.

The top portion 100 may have a sealing element 108 that is configured to form a closure that permits a water tight seal when the top portion 100 is reattached to the main body 104 of the personal egg peeler. The sealing element may consist of clip fastening, gasket, screw type element, o-ring element, slide and lock connection, or any other fastening structure that permits the top element 100 to be attached to and removed from the main body 104 of the personal egg peeler while maintaining a water tight seal when the top portion 100 is fully secured to the main body 104. The top portion 100 may also be manufactured of a material such as rubber, plastic, silicon, acrylic, or any other equivalent material, that permits a water tight seal to be maintained when the top portion 100 is fully secured onto the top portion of the main body 104 of the personal egg peeler.

The bottom portion 110 of the personal egg peeler may also be convex in shape. The convex shaped portion 102 of both the top portion 100 and the bottom portion 110 permits each end portion to participate in the action by forming a grip for a user to firmly grasp the personal egg peeler when in use. As such, it is readily apparent that the convex shaped portion 102 is not the only shape in which the top portion 100 and the bottom portion 110 may be manufactured. Additional shapes that permit a firm grasp of the top portion 100 and the bottom portion 110 of the personal egg peeler, such as a flat surface with protrusions, a wavy surface, a central cone, or any other shaped indentation, are equally disclosed as being consistent with the purpose of the convex shaped portion 102 of the top portion 100 and the bottom portion 110 of the personal egg peeler.

Figure 2:
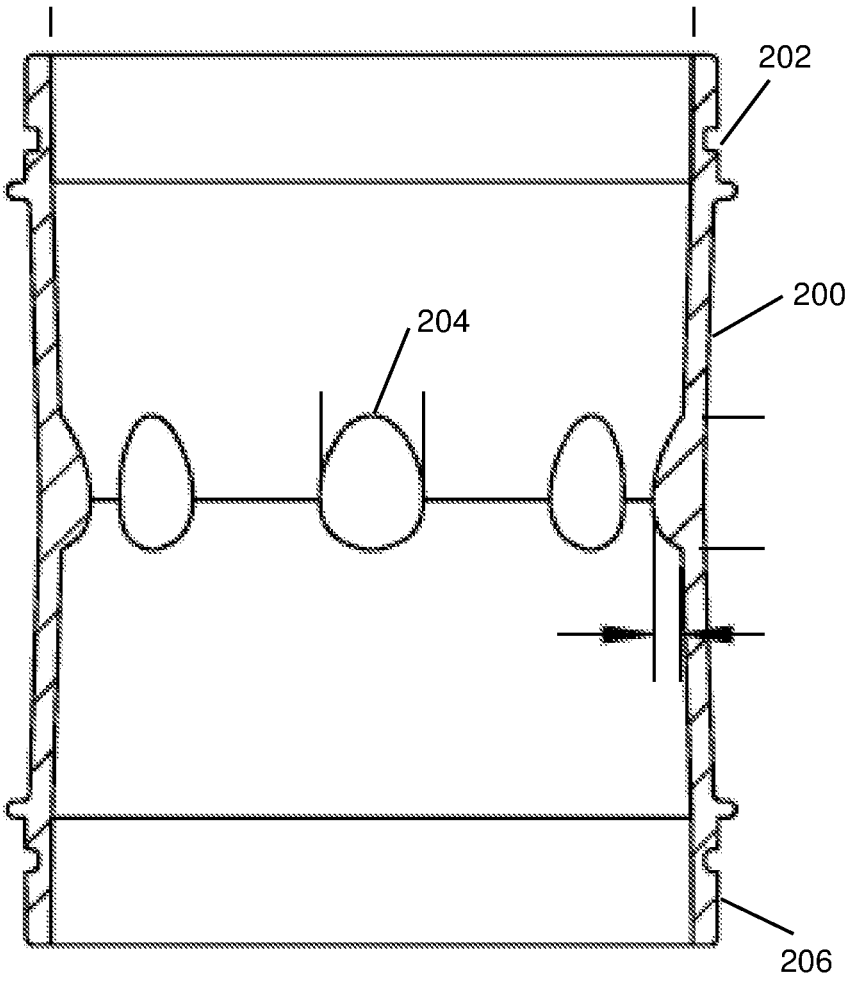
FIG. 2 is a view of the main body of a personal egg peeler apparatus consistent with certain embodiments of the present invention.

Turning now to FIG. 2, consistent with certain embodiments of the invention is a view of the main body of a personal egg peeler apparatus consistent with certain embodiments of the present invention. In an exemplary embodiment, the main body 200 of the personal egg peeler may be configured in any shape that permits the complete enclosure of one or more eggs when the eggs are inserted into the main body 200. The main body 200 may be manufactured of any material, such as glass, plastic, acrylic, or any other material that is water proof and has a hardness greater than the hardness of the shell of an egg to be inserted. In a non-limiting example, the main body 200 of the personal egg peeler is presented as a hollow cylinder. However, the main body 200 could equally well be manufactured as a hollow square, rectangular, oval, or other shape that would permit the complete insertion of one or more eggs into the hollow portion of the main body 200.

The inner surface of the main body 200 may have raised protrusions 204 that extend into the hollow space within the main body 200. The raised protrusions 204 may be manufactured as a seamless portion of the interior surface of main body 200, or they may be manufactured separately and later attached to the interior surface of the main body 200. In this exemplary embodiment, the raised protrusions 204 contribute to the action of peeling the one or more eggs inserted into the personal egg peeler.

In an exemplary embodiment, the top portion 100 and bottom portion 110 of the personal egg peeler may be manufactured as separable end portions of the personal egg peeler. A top connector portion 202 and a bottom connector portion 206 may be shaped to form a locking connection with the top portion 100 and bottom portion 110 when placed in contact with the main body 200 of the personal egg peeler.

When preparing to use the personal egg peeler, either the top portion 100 or the bottom portion 110 may be removed from contact with the main body 200. At this point, one or more eggs may be inserted into the main body 200 of the apparatus making the apparatus ready for use in removing the peel from a hard-boiled egg or eggs, depending upon the size and configuration of the apparatus. Water is placed in the cavity of the main body 200 to a level that is approximately one third of the volume of the interior of the main body 200. Alternatively, in another exemplary embodiment, a water level marker may be indicated on the exterior of the apparatus to provide a user with a guideline for the water level that is preferred when using the apparatus. The top portion 100 or bottom portion 110, whichever was removed to permit the insertion of the egg(s) and water, is placed fully in contact with the main body 200 so as to form a sealed, water tight container around the one or more inserted eggs. The user may then firmly grasp the personal egg peeler by the top and bottom convex, or other shaped, portions and operate the apparatus by shaking the personal egg peeler vigorously.

In this exemplary embodiment, the top portion 100 and the bottom portion 110 of the apparatus are fully removable to facilitate cleaning of the interior of the main body 200 of the personal egg peeler apparatus.

Figure 3:
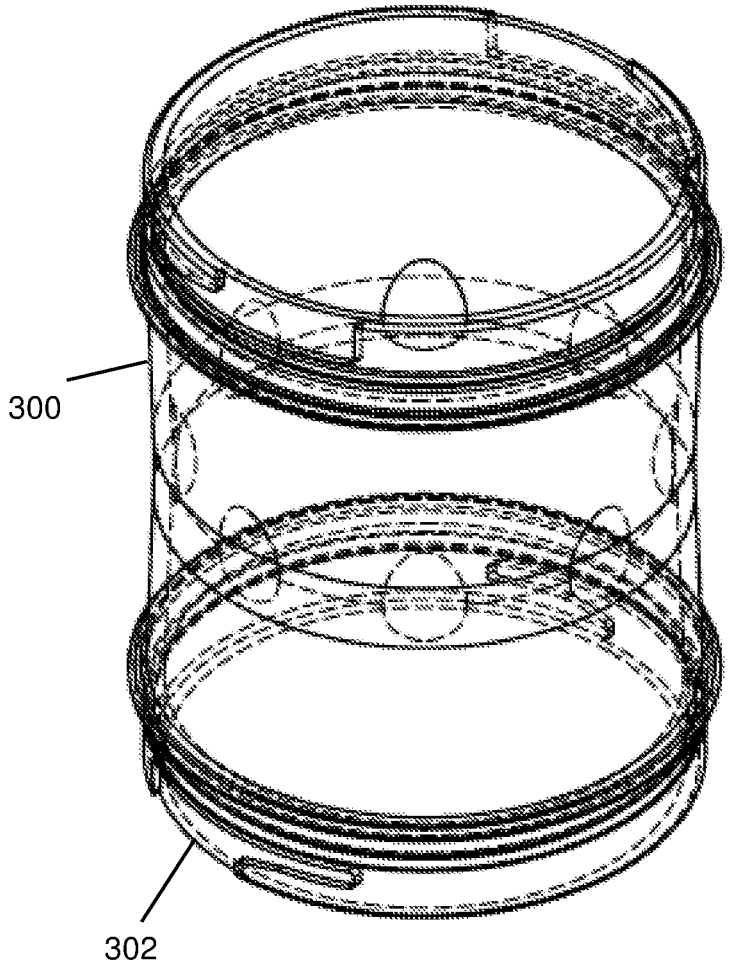
FIG. 3 is a view of a main body and end portion connectors of a personal egg peeler consistent with certain embodiments of the present invention.

Turning now to FIG. 3, consistent with certain embodiments of the invention is a view of a main body and end portion connectors of a personal egg peeler consistent with certain embodiments of the present invention. In this exemplary embodiment, the main body 300 of the personal egg peeler may be connected to a top capping portion and a bottom capping portion (not shown) through the connection point 302 formed as a part of the main body 300 top and bottom sections. The connection point 302 may be formed as a locking channel that permits the insertion of a top cap or a bottom cap and forming a water tight seal as the top cap and/or bottom cap are turned to secure the top cap or bottom cap in the locking channel. It is understood that a locking channel is simply one implementation of the water tight seal between the end caps and the main body 300 of the apparatus. Additional sealing mechanisms that may form a water tight seal when fully engaged may include clip fasteners, gaskets, a screw type element, an o-ring element, slide and lock connection, or any other fastening structure that permits the end caps to be firmly attached to the main body 300 and forming a water tight seal.

Figure 4:
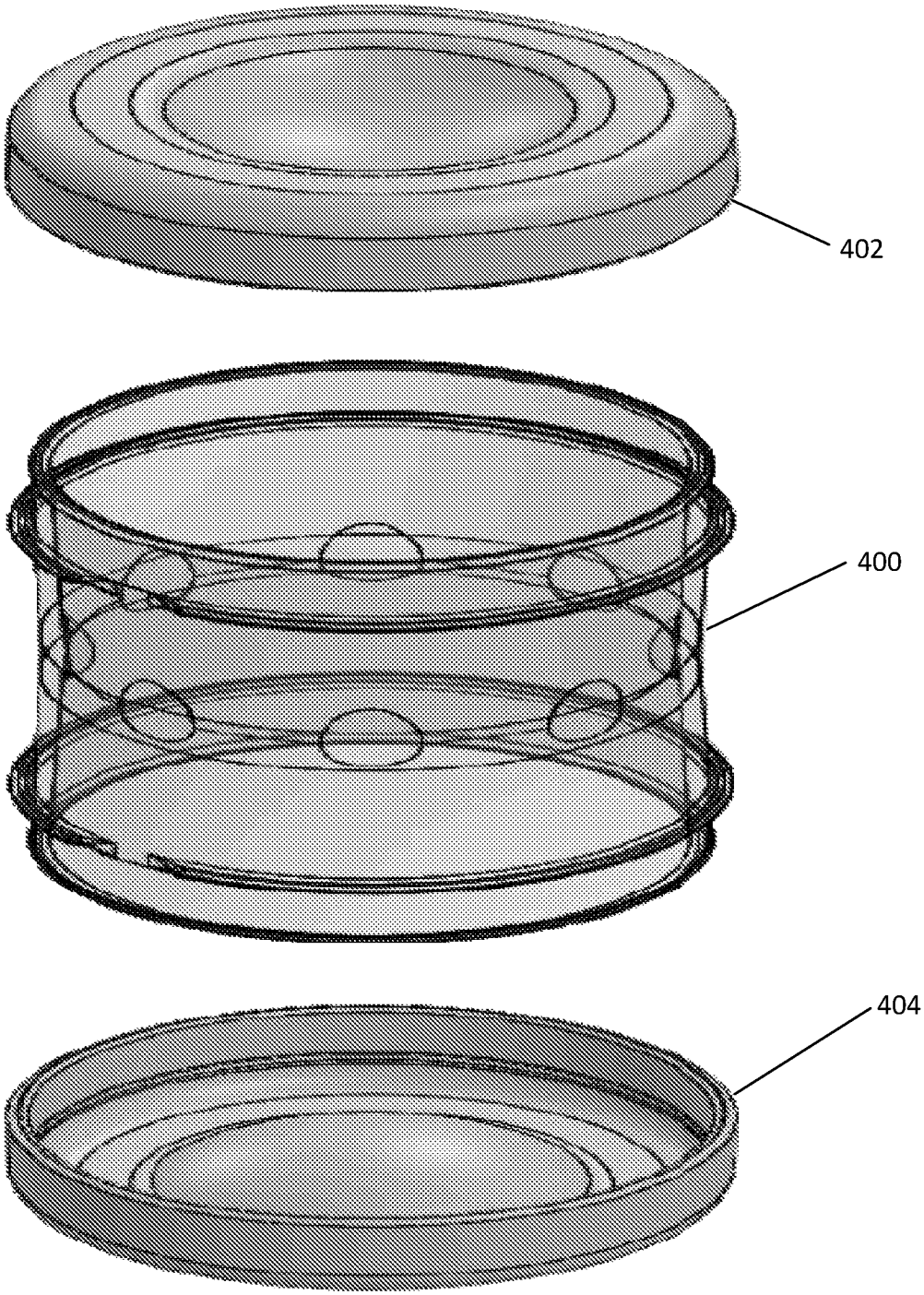
FIG. 4 is a view of a main body and end portion connectors of a personal egg peeler in an exploded view consistent with certain embodiments of the present invention.

Turning now to FIG. 4, consistent with certain embodiments of the invention is an exploded view of a main body and end portion connectors of a personal egg peeler consistent with certain embodiments of the present invention. In this exemplary view, the main body 400 of the personal egg peeler is a hollow structure that permits the insertion of one or more eggs into the hollow cavity forming the main body 400. Although the main body 400 is circular in cross section in this exemplary embodiment, this should in no way be considered limiting, as the main body 400 may be of any shape in cross section as long as the central portion of the main body has a cavity that accepts the insertion of one or more eggs in such as fashion as to permit the top end cap 402 and the bottom end cap 404 to be securely fastened to the main body 400 with the eggs fully inserted. The top end cap 402 and the bottom end cap 404 are configured to permit the end caps to be fastened to the top portion and the bottom portion of the main body 400, respectively, to form a water tight seal with the one or more eggs fully inserted into the main body 400.

Figure 5:
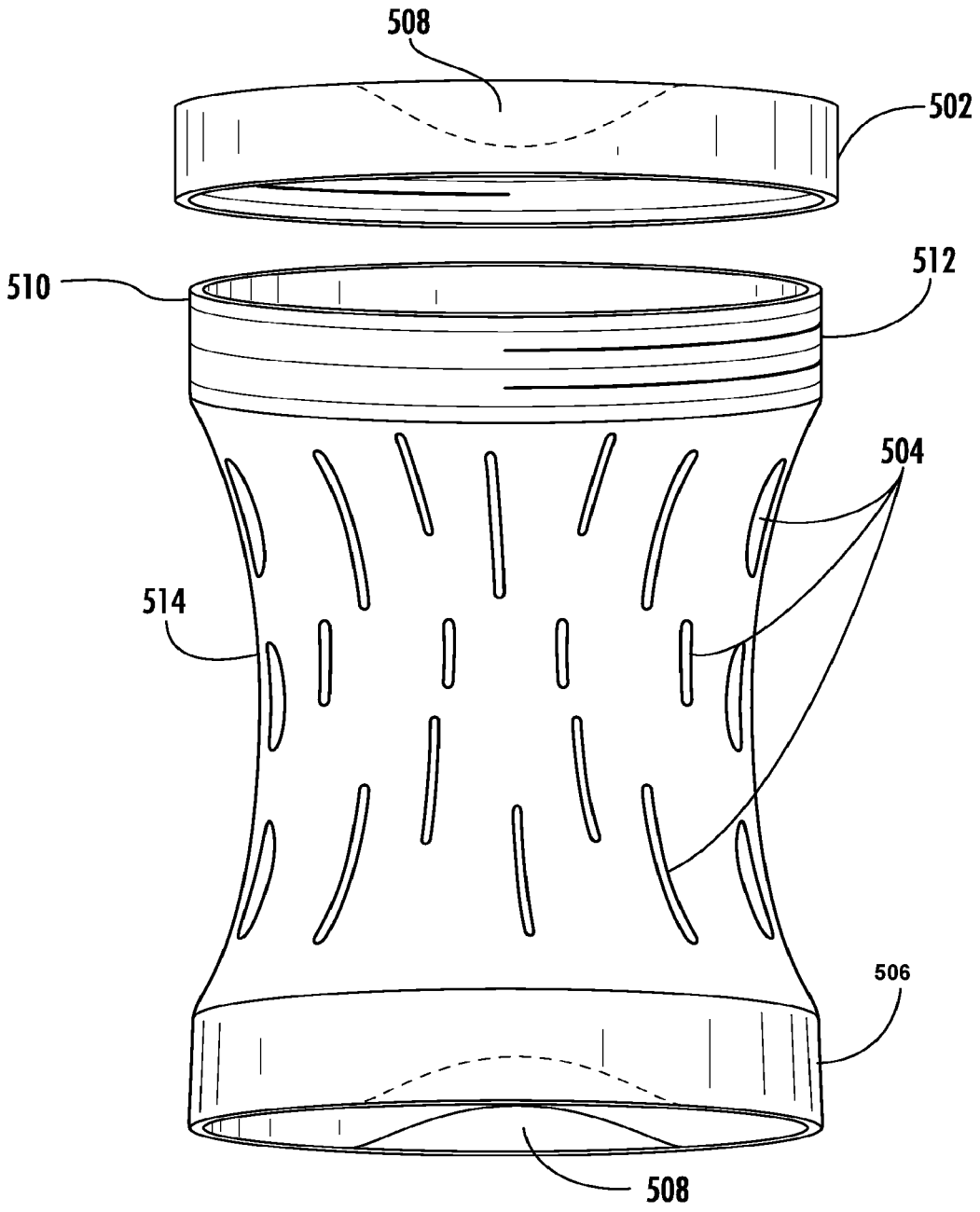
FIG. 5 is a view of an improved main body and end portion connectors of a personal egg peeler consistent with certain embodiments of the present invention.

Turning now to FIG. 5, this figure presents a view of an improved main body and end portion connectors of a personal egg peeler consistent with certain embodiments of the present invention. In an embodiment, the top end cap 502 and the bottom end cap 506 may be attached to the top portion and the bottom portion of the cylindrical main body, when the main body is oriented in a vertical direction, through a screw on section 512 of the top portion and the bottom portion (not shown) of the cylindrical main body. On the interior surface of the cylindrical main body are attached a pattern of convex amorphous-shaped nodules 504. The convex amorphous shaped nodules 504 are raised protrusions of sufficient height to extend into the hollow are of the cylindrical main body and are disposed around the entire interior surface of the cylindrical main body. The convex amorphous shaped nodules 504 form a pattern extending from the bottom end cap of the container to the top end cap of the container and extending around the entire interior surface of the container.

In an embodiment, the top end cap 502 and the bottom end cap 506 may also have a convex depression 508 of sufficient depth to permit a user to place at least one finger wholly within the convex depression 508 so as to permit a stronger, more secure grip on the device as a whole when a user is shaking the device to peel one or more eggs. To ensure a water-tight seal, a rubber gasket 510 may be positioned at either end of the cylindrical main body, where the rubber gasket 510 may fit entirely within the circumference of the top end cap 502 and the bottom end cap 506 so as to secure each cap against leakage of any water contained in the cylindrical main body. Additionally, the cylindrical main body may have a pronounced hourglass shape 514 to permit more forceful circulation of any water contained within the cylindrical main body during egg cracking actions.

Figure 6:
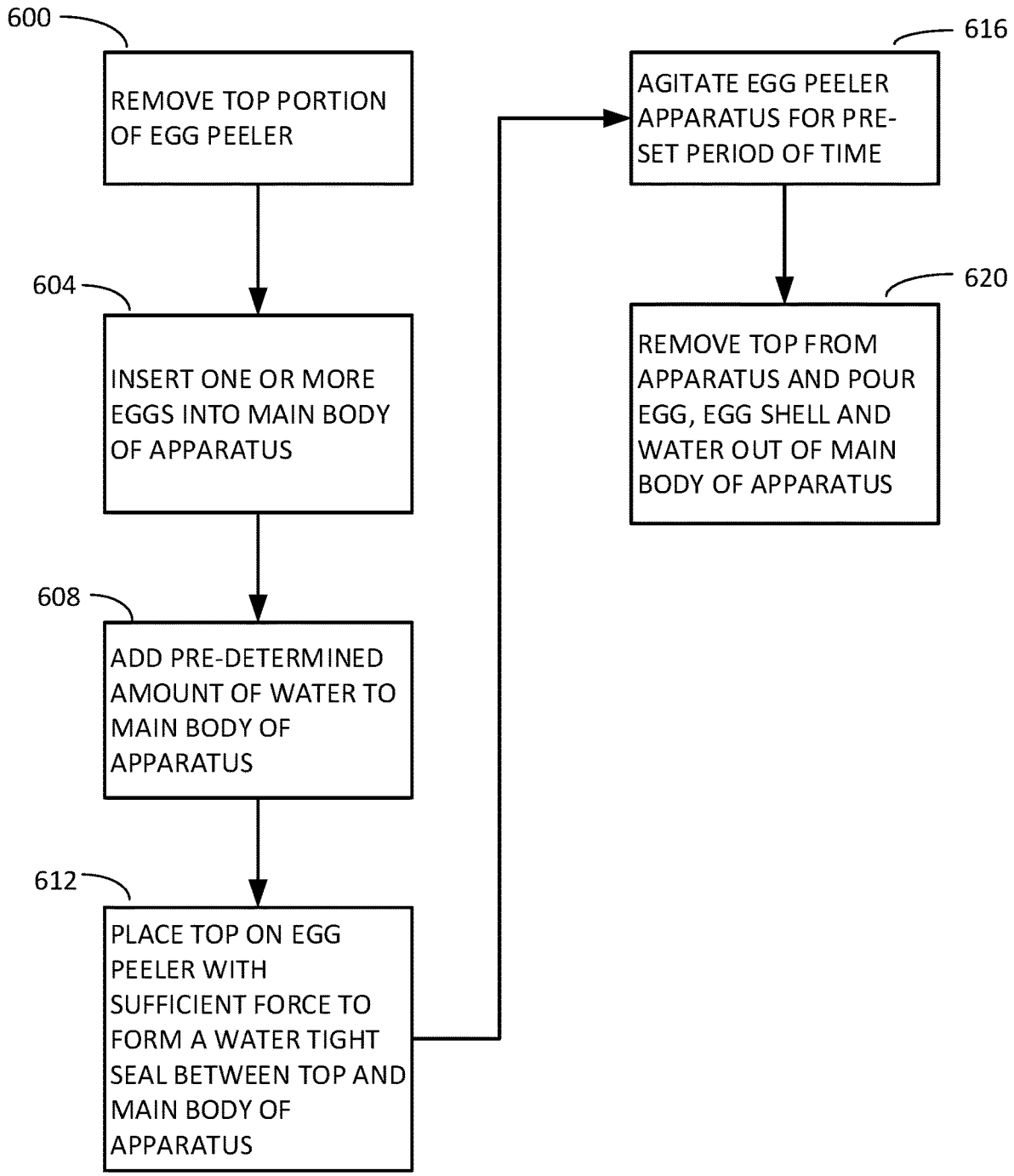
FIG. 6 is a flow diagram for the operation of a personal egg peeler consistent with certain embodiments of the present invention.

Turning now to FIG. 6, consistent with certain embodiments of the invention is a flow diagram for the operation of a personal egg peeler consistent with certain embodiments of the present invention. In this exemplary embodiment, the action of peeling one or more eggs in the personal egg peeler begins at step 600 when a user removes an end cap, either the top portion or the bottom portion, of the personal egg peeler. At step 604, the user may place just one egg, or more than one egg, depending upon the size of the eggs relative to the hollow body section of the personal egg peeler. The user may only place the number of eggs into the personal egg peeler that will fit inside with sufficient clearance to permit the top of the personal egg peeler to be placed back into contact with the main body of the personal egg peeler so as to form a water tight seal, and will permit unrestrained movement of the egg, or eggs, inside the personal egg peeler.

At step 608, the user may add water to the main body of the personal egg peeler in sufficient quantity to fill a third of the interior of the main body, or sufficient water to rise to the indicator marking on the exterior surface of the main body of the personal egg peeler. At step 612, the user places the removed portion, whether the top portion or the bottom portion, of the personal egg peeler back into contact with the main body of the personal egg peeler. The placement of the removed portion of the egg peeler must be such that the top, or bottom, portion is in full contact along the entire extent of the gasket with the interior surface of the main body of the personal egg peeler and put in place with sufficient force so as to form a water tight seal between the gasket part and the interior surface of the main body of the personal egg peeler.

At step 616, the user performs the egg peeling action by picking up the personal egg peeler and agitating the personal egg peeler in up and down, and circular motions for a pre-determined period of time. The pre-determined period of time may be approximately ten seconds or may be adjusted based upon user experience or the number of eggs that have been inserted into the personal egg peeler to a greater or lesser extent to achieve a complete peeling action. At 620, the user, after agitating the personal egg peeler for the pre-determined period of time, may remove the end cap portion of the personal egg peeler and pour out the separated egg and egg shell along with the water added earlier in the process. When completed, the top and bottom portions of the personal egg peeler may be removed to facilitate cleaning.

While certain illustrative embodiments have been described, it is evident that many alternatives, modifications, permutations and variations will become apparent to those skilled in the art in light of the foregoing description.

What is claimed is:

1. An egg peeler apparatus, comprising:

a container having a hollow main body;

a top portion having a physical connection and seal when top portion is connected to the hollow main body;

said top portion having a convex shaped portion and forming a top portion of the container;

said top portion further comprising a concave portion that forms an indentation in the center of said convex shaped portion of said top portion;

the interior surface of the hollow main body of said container having a plurality of raised protrusions of sufficient height to extend into the hollow area of the hollow main body of said container, said raised protrusions forming a pattern extending from the bottom of the hollow main body of said container to the top of the hollow main body of said container;

the hollow main body of said container having an internal dimension of sufficient diameter to permit insertion of one or more standard size chicken and/or duck eggs;

the apparatus configured to peel the one or more standard sized chicken and/or duck eggs inserted into the hollow main body of said container when agitated by a user.

2. The apparatus of claim 1, where the main body of the container may have an external shape that is cylindrical, oval, square, rectangular, or any other shape that permits the top portion to be inserted into or onto the top of said hollow main body.

3. Claim 1, where the top portion forms a water tight seal when securely fastened to the top of the main body of the container.

4. The apparatus of claim 1, where the raised protrusions are formed of the same material as the interior surface of said hollow main body of the container.

5. The apparatus of claim 4, where the raised protrusions are shaped in an oval, rectangular, circular, square, or any other shape that is operative to form a protrusion against which an egg shell may impact, and a pattern of raised protrusions is sufficiently placed to permit impact of the egg against a raised protrusion regardless of location of the egg within said main body of the container.

6. The apparatus of claim 1, where the main body of the container is of sufficient dimension to be held by a user.

7. The apparatus of claim 1, further comprising a fastening portion extending from said top portion forming a seal between said top portion and said main body of the container where the fastening portion permits a user to remove said top portion to remove any eggs and egg shells and to clean the interior of said hollow main body of the container.

8. The apparatus of claim 1, where the interior volume of said hollow main body of the container is sufficient to permit the insertion of at least one grade A large chicken egg and/or a grade A large duck egg.

* * * * *